US006508476B2

(12) United States Patent
Joubert Des Ouches

(10) Patent No.: US 6,508,476 B2
(45) Date of Patent: Jan. 21, 2003

(54) SNOWBOARD BINDING

(75) Inventor: Pascal Joubert Des Ouches, Coublevie (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/771,727

(22) Filed: Jan. 29, 2001

(65) Prior Publication Data

US 2001/0015541 A1 Aug. 23, 2001

(30) Foreign Application Priority Data

Jan. 28, 2000 (FR) ..... 00 01100

(51) Int. Cl.[7] ..... A63C 9/00

(52) U.S. Cl. ..... 280/14.22; 280/611; 280/623; 280/11.36; 36/117.1

(58) Field of Search ..... 280/623, 611, 280/618, 617, 11.3, 14.24, 14.21, 14.22, 11.36; 36/117.1, 119.1

(56) References Cited

U.S. PATENT DOCUMENTS 3,439,434 A * 4/1969 Tangorra ..... 36/2.5
5,356,170 A * 10/1994 Carpenter et al. ..... 280/618
5,575,091 A * 11/1996 Mattiuzzo ..... 36/118.2
5,606,808 A * 3/1997 Gilliard et al. ..... 36/89
5,815,953 A 10/1998 Kaufman et al.
6,076,287 A * 6/2000 Savard ..... 36/118.2
6,112,435 A * 9/2000 Collavo ..... 36/117.1
6,116,635 A 9/2000 Rigal
6,170,175 B1 * 1/2001 Funk ..... 36/89
6,231,057 B1 * 5/2001 Reuss ..... 280/14.21

FOREIGN PATENT DOCUMENTS

DE 198 45 467 A 4/1999
EP 0 858 818 A1 2/1998
JP 02000093571 A * 4/2000 ..... 36/117.1
JP 02000288151 A * 10/2000 ..... 36/117.1

* cited by examiner

*Primary Examiner*—Brian L. Johnson
*Assistant Examiner*—Kelly E Campbell
(74) *Attorney, Agent, or Firm*—Heslin Rothenberg Farley & Meaiti P.C.; Victor A. Cardona, Esq.

(57) ABSTRACT

Highback for a snowboard binding intended to come into contact with the rear part of the user's boot in order to withstand the back thrusts thereof, having a median longitudinal plane of symmetry, which has a stiffer region located asymmetrically with regard to the median longitudinal plane of symmetry of the highback.

20 Claims, 2 Drawing Sheets

SNOWBOARD BINDING

TECHNICAL FIELD

The invention relates to the field of sliding sports and more precisely to that which is known as snowboarding. It relates more particularly to an optimized snowboard-binding highback for the transmission of forces.

Prior Art

As is known, snowboarding may be practiced using different techniques which make use either of stiff boots or soft boots. The invention refers to bindings intended to secure soft boots to the snowboard.

A binding of this type is generally formed by a baseplate, which is screwed onto the board and on which the boot sole rests.

In order to allow transmission of the back thrusts, a binding of this type also includes a highback which is mounted on the baseplate either directly or by means of a rear heel cup passing behind the boot.

In a known manner, the highback is preferably mounted so as to pivot with regard to the heel cup or to the baseplate in order to be folded down forward in order to limit the overall volume of the binding when it is not in use. This highback abuts rearward in its position of use, since the aim of the highback is to provide back thrusts, particularly when the user makes turns on the rear edge, generally known as "backside" turns.

In point of fact, as the boot used is soft for reasons of comfort, it tends to deform when the user exerts rearward forces and it is necessary for the binding to have a part which receives such forces and transmits them in the direction of the rear edge.

Moreover, it is known that the position of the user's feet on the snowboard is not exactly perpendicular to the median longitudinal plane of the board, but is, on the contrary, slightly offset.

The front foot is generally oriented more to the front of the board, while the rear foot may be either closer to the perpendicular or slightly oriented forward or slightly oriented rearward.

This latter orientation is more generally adopted by users practicing the "freestyle" technique. In this technique, the rider performs a number of figures which require him to move in both the directions of the snowboard, which explains why snowboards intended for this type of riding are symmetrical, i.e. they have two similar tips.

Within the context of this sport, the rider frequently has to perform jumps. Upon landing after a jump, the rider leans forward or backward, and he needs to have a support that can take this force exerted in the direction of movement or in the opposite direction. It will therefore be understood that it is important for the binding to provide support in the direction opposite to that of movement.

To meet this requirement, it has already been proposed to adapt existing bindings, allowing the highback to pivot about the axis of the leg so as to bring it opposite the outer part of the leg, thus corresponding to a support located in the direction opposite to that of movement. This arrangement also has the advantage of releasing the inner part of the leg and facilitates flexing of the latter, particularly when executing figures.

Unfortunately, existing highbacks are insufficiently stiff to provide effective support, particularly given the high degree of momentum exerted when landing after a jump.

Moreover, it is observed that, when the binding is not perpendicular to the median longitudinal plane of the board, it is the outer region of the foot which is closest to the rear edge, and that the support is therefore not provided in an optimum manner.

Solutions have already been proposed which consist in configuring the highback in such a way that it has a portion opposite the outer region of the leg for receiving the forces exerted closest to the edge.

A solution of this type is described, in particular, in document FR 2 769 239.

The solution described in said document consists in giving the highback an asymmetric geometry in which a protruding part is provided on the outer side of the highback, in the upper half of the latter. The objective of a geometry of this type is to allow the take-up of the forces exerted toward the outer rear part of the foot.

A solution of this type nevertheless has many drawbacks.

In point of fact, the protruding region is an element of not insignificant weight, and this weight is added to the rest of the binding.

Furthermore, this protruding region is reasonably fragile since it is located projecting from the actual body of the highback.

More precisely, the region of the join between this protruding part and the rest of the highback is flexible and therefore does not allow the highback to provide all the stiffness that is required, except at the cost of a disproportionate increase in thickness which is reflected in drawbacks in terms of weight and manufacture.

More generally, in order to obtain a sufficiently stiff highback of this type, it is necessary to use a material which is either much thicker or much stiffer, which renders the whole highback heavy and stiff, whereas certain parts of the highback do not require this.

In other words, one of the problems which the invention proposes to solve is the optimization of the geometry and architecture of the highback in order to combine at one and the same time the properties of equired stiffness and optimum transmission of forces while retaining a degree of facility of manufacture and the possibility of varying the stiffness of the highback over its entire surface.

A further drawback of asymmetric highbacks as described in the document cited above, lies in the fact that two molds are required for producing highbacks intended for the right and left feet.

SUMMARY OF THE INVENTION

The invention thus relates to a highback for a snowboard binding intended to come into contact with the rear part of the user's boot in order to withstand back thrusts and having a median longitudinal plane of symmetry.

The highback according to the invention has a stiffer region located asymmetrically with regard to its median longitudinal plane of symmetry.

In other words, the highback according to the invention is symmetrical in its shape but its mechanical properties, particularly its stiffness, are asymmetrical.

The stiffness of the highback is therefore located solely in those places where it is required, which makes it possible for the remainder of the highback to retain a degree of flexibility which may be advantageous in terms of comfort.

It is therefore unnecessary excessively to increase either the thickness or the weight of the highback in order to obtain the required stiffness for effective transmission of back thrusts.

Advantageously, the stiffer region is located on the outer side of the foot, in order to optimize support.

Several embodiments may be adopted. Thus, in a first variant, the stiffer region of the highback may consist of an element embedded inside the constituent material of the highback.

This element may be either a resin-coated glass fabric or a metal grid, or, alternatively, any equivalent element.

In the case in point, a single mold is required for producing not only highbacks intended for mounting on the left binding but also highbacks intended for mounting on the right binding, which reduces manufacturing costs.

In a further variant embodiment, the highback may be produced by multi-injection, one of the multi-injected regions then constituting the stiffer region.

The choice of plastics materials and, in particular, the relative stiffness ratio of the two materials used is optimized in order to obtain the best weight/stiffness compromise.

Advantageously, in practice, the stiffest region may partially traverse the median plane of symmetry of the highback, particularly at the upper edge of said highback, in order to make this variation in stiffness progressive.

The highback according to the invention may be mounted on bindings with or without the possibility of being enabled to pivot about a vertical axis.

BRIEF DESCRIPTION OF THE FIGURES

The way in which the invention is embodied and the advantages arising therefrom will become clearly apparent from the description of the embodiments which follow in support of the appended figures, in which.

EMBODIMENT OF THE INVENTION

The invention relates to a snowboard binding which has a highback, one of the essential characteristics of which is to offer symmetrical geometry whereas its mechanical properties and, in particular, its stiffness are distributed asymmetrically.

Figure 1:
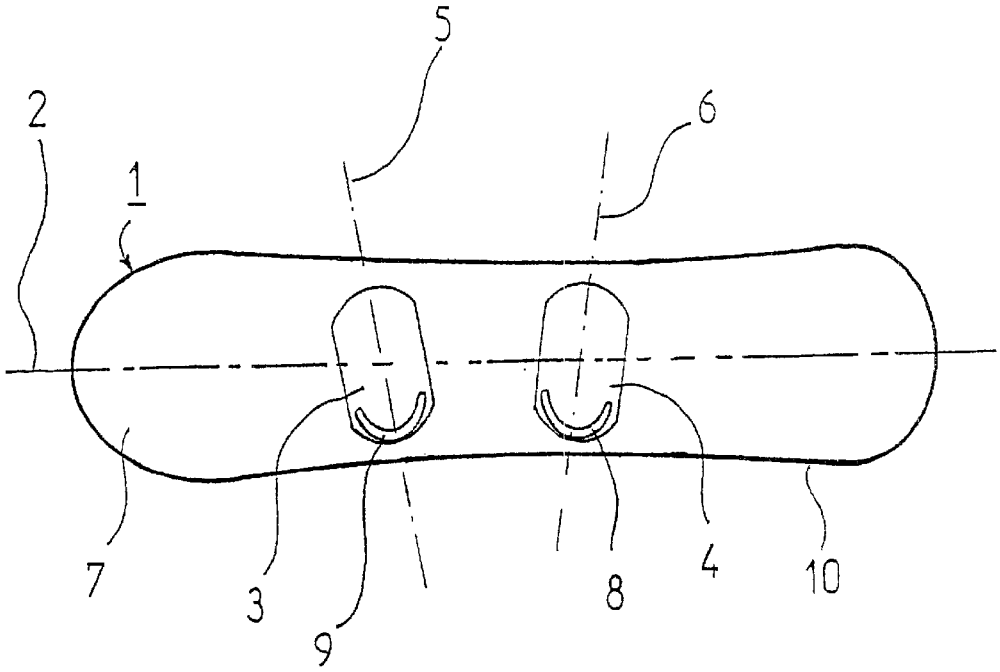
FIG. 1 is a diagrammatic view from above of a snowboard on which two bindings according to the invention are placed.

Generally speaking, as may be seen in FIG. 1, a snowboard (1) has a median longitudinal plane 2 which is not necessarily a plane of symmetry, but which more generally defines the direction of movement.

In other words, the invention may be adapted to various types of snowboard, irrespective of whether the board is asymmetrical or not.

In a known manner, a snowboard (1) of this type receives two bindings (3, 4) which are arranged in the central region of the board.

These bindings (3, 4) generally have a median longitudinal plane (5, 6) which is not necessarily a plane of symmetry, but which defines the orientation of the foot.

Many riding styles have been developed in which the orientation of the foot may adopt different angles with regard to the median longitudinal plane (2) of the board.

Generally speaking, the foot located on the tip side (7) of the board, which corresponds to the front of the latter, has an orientation (5) which faces forward.

The rear foot may adopt different orientations. Thus, in the variant illustrated in FIG. 1, the foot located on the tail side of the board may be oriented in the direction of the rear of the board, which corresponds to the position generally known as the "duck stance".

In other variants which are not shown, the rear foot may be oriented either practically perpendicularly to the longitudinal axis (2) of the board, or, alternatively, oriented in the same direction as the front foot, in the direction of the front of the board.

The invention offers advantages in the various styles and, in particular, in the "duck stance" position used in "freestyle".

As regards the first style, which is shown in FIG. 1, the plane of symmetry of the highback is merged with that of the binding. It will be noted that the outer regions (8, 9) of the foot, located to the left of the median longitudinal plane (5) of the binding in the case of the left foot, and to the right of the median plane (6) in the case of the right foot, are the parts closest to the rear edge (10).

In order for the back thrusts to be transmitted effectively and for optimum edge gripping to be achieved, it is preferable for the forces exerted by the rider to be transmitted closest to this rear edge (10).

Figure 2:
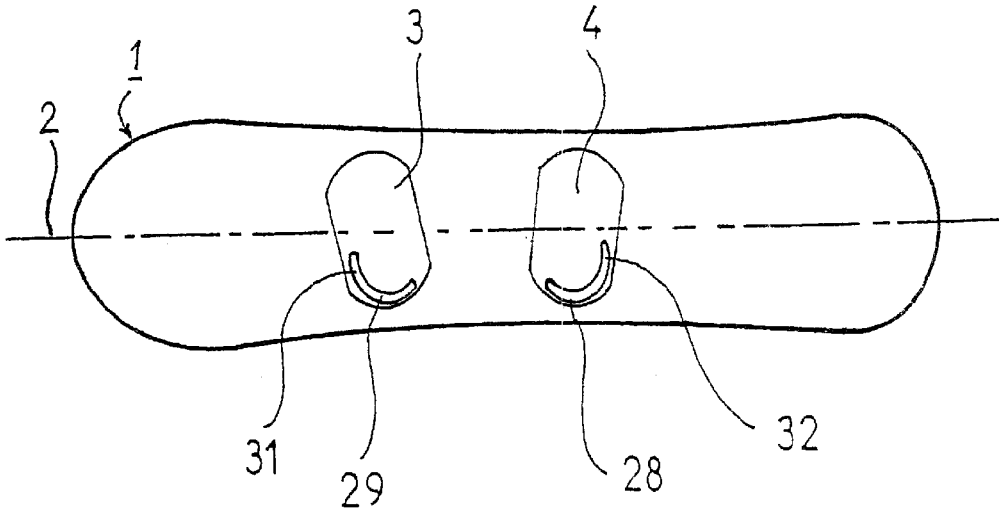
FIG. 2 is a diagrammatic view from above of a snowboard on which two bindings according to the invention are placed, in a "freestyle" riding configuration.

In another style, which is illustrated in FIG. 2, the bindings (3, 4) used have a highback (28, 29) which may be pivoted on the outer side of the foot. This pivoting takes place about an axis which corresponds to that of the leg. In this case, by virtue of this pivoting of the highback, the outer part (31, 32) of the latter is in a position which is intended to oppose the forces exerted parallel to the median longitudinal plane (2) of the board in the direction of advance.

This configuration enables the rider to receive support which allows him to regain his balance, particularly when landing after a jump. Such support is provided for the left and right feet.

Complementarily, pivoting of the highback (28, 29) toward the outside of the foot makes it possible to release the inner region of the leg and therefore to allow the rider more easily to orient his leg forward, which is the ergonomic position for "freestyle" riding.

Therefore, according to the invention, the highback (12) of the binding (11) is stiffer on the outer side.

Figure 3:
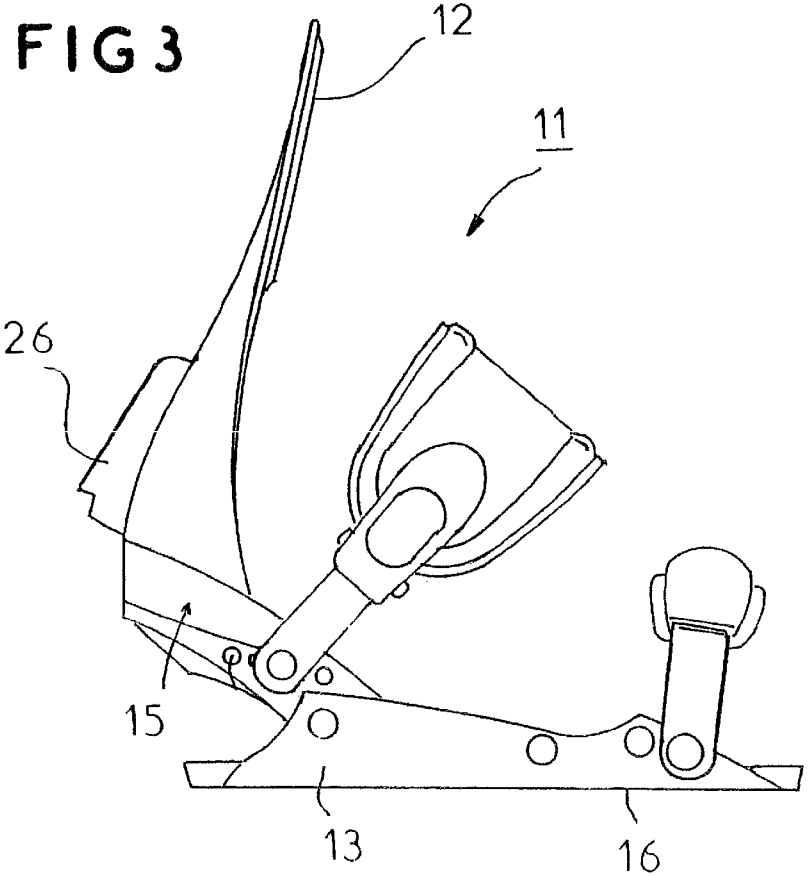
FIG. 3 is a side view of a binding according to the invention.

More precisely, and as illustrated in FIG. 3, a binding (11) generally includes a baseplate (13) and a highback (12) which is mounted generally so as to pivot on the rear part of the baseplate which may, by way of non-limiting example, be produced in the form of a heel cup (15) passing around the rear of the foot.

Of course, the invention is not limited to this type of binding, but covers any type of architecture from the point when the highback (12) exhibits asymmetry in its mechanical properties while retaining geometrical symmetry.

Therefore, as illustrated in FIG. 3, the baseplate (13) of the binding has a lower face (16) which is intended to come into contact either directly, or indirectly via an interface element, with the upper face of the board.

According to a characteristic of the invention, the highback has geometrical symmetry about a median longitudinal plane (20) which is itself perpendicular to the lower face (16) of the baseplate (13).

Figure 4:
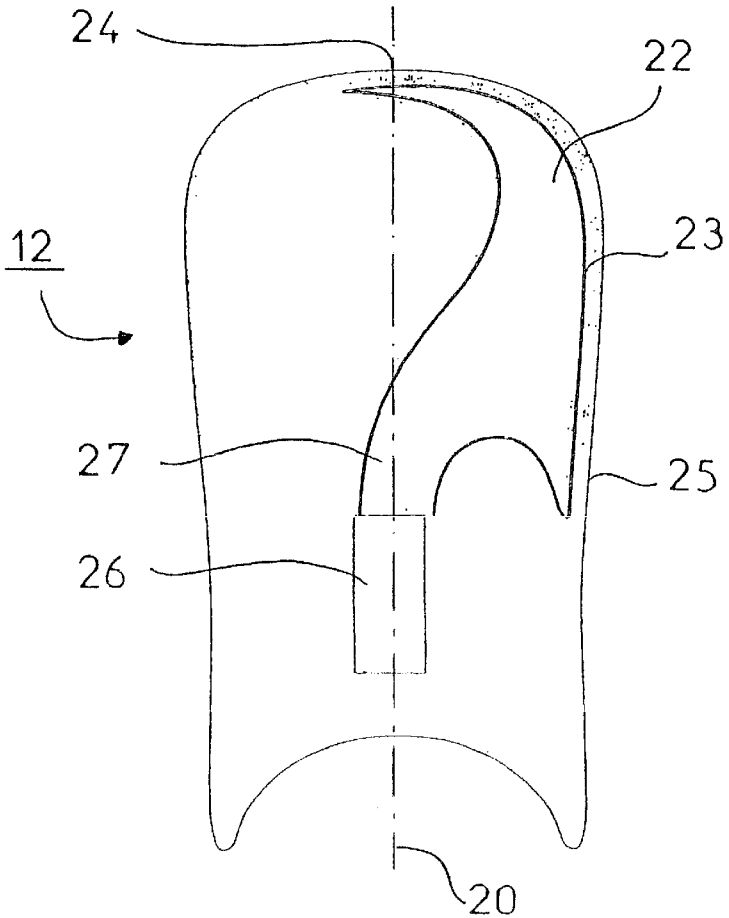
FIG. 4 is a rear view of a highback produced according to the invention.

According to a further characteristic of the invention, and as illustrated in FIG. 4, the highback has a region of greater stiffness arranged asymmetrically with regard to the plane of symmetry.

Many different architectures may be adopted in order to distribute stiffness asymmetrically, and the invention is in no way limited to the form of the stiffer regions illustrated in FIG. 4.

In this example, the stiffer region is essentially located at the top of the highback (12) and, mostly, on the outer side of the plane of symmetry (20) of the highback.

In a preferred embodiment, the stiffer region (22) extends at least to the periphery (23) of the highback (12), located at the top and in the outer part of the latter.

In the embodiment illustrated by way of non-limiting example in FIG. 4, this stiffer region (22) covers most of the perimeter (23) of the highback, from the top (24) of the latter as far as approximately mid height (25).

A very stiff region (22) of this type also extends in the direction of the stop (26) located at the rear of the highback (12), on the longitudinal plane of symmetry (20), and which is intended to interact with the top of the heel cup (15) when the forces are exerted rearward by the rider.

This extension (27) constitutes a mechanical link which allows satisfactory transmission of back thrusts from the top of the highback (12) to the stop (20), and thus the heel cup (15) of the binding.

A number of manufacturing methods may be employed in order to obtain a highback of this type. Thus, a highback may be produced from a molded plastics material having a modulus of elasticity in flexure of between 1,000 and 3,000 Mpa.

In this case, the stiffer region (22) may be formed by an additional element forming an insert inside the highback, which may be formed either from a resin-coated glass-fiber fabric or, alternatively, from a metal grid which is much stiffer than the rest of the highback.

In this latter case, the same mold may be used to produce the right or left binding highbacks, only the inclusion of an insert inside the mold differing between the two sides.

The same type of insert may be used for left and right bindings as it is placed inside the mold in one or the other orientation.

The highbacks may also be produced integrally from plastics material using a multi-injection technique.

In this case, the stiffer region is produced from a material which is different from that of the rest of the highback and which has, for example, a modulus of elasticity in flexure of between 6,000 and 10,000 Mpa, while the rest of the highback has a modulus of elasticity in flexure of between 1,000 and 3,000 Mpa.

In this case, the stiffer region may emerge at the rear of the highback so as to be visible. It may also be embedded inside the material constituting the rest of the highback.

It emerges from the aforesaid that a snowboard binding equipped with a highback according to the invention offers many advantages and, in particular:

- significant stiffness located solely in those places where it is required for the satisfactory transmission of the back thrusts closest to the edges and to the outside of the foot for landing after a jump;
- relative flexibility of the rest of the highback which is not intended to transmit the forces, which enhances comfort;
- compactness of the symmetrical form which limits the risks of deformations, damage and, possibly, the risks of breakage;
- the possibility of using a single mold to produce left and right highbacks when the very stiff region is produced by means of an insert.

What is claimed is:

1. A highback for a snowboard binding for receiving a rear part of a user's boot, said highback having a median longitudinal plane of symmetry, said highback comprising a symmetrical shape relative to said median longitudinal plane of symmetry and said highback comprising a stiffer region located asymmetrically with regard to the median longitudinal plane of symmetry of the highback, said stiffer region adapted to receive back thrusts of said user and said stiffer region located on an outer side of the user's boot.

2. The highback as claimed in claim 1, wherein the stiffer region consists of an element embedded inside the constituent material of the highback.

3. The highback as claimed in claim 2, wherein the element is a resin-coated glass-fiber fabric.

4. The highback as claimed in claim 3 wherein the stiffer region is located on the outer side of the user's boot.

5. A snowboard binding equipped with a highback as claimed in claim 3.

6. The highback as claimed in claim 2, wherein the element is a metal grid.

7. The highback as claimed in claim 6 wherein the stiffer region is located on the outer side of the user's boot.

8. A snowboard binding equipped with a highback as claimed in claim 4.

9. The highback as claimed in claim 2 wherein the stiffer region is located on the outer side of the user's boot.

10. A snowboard binding equipped with a highback as claimed in claim 2.

11. The highback as claimed in claim 1, wherein the highback is produced by multi-injection, one of the multi-injected regions constituting the stiffer region.

12. The highback as claimed in claim 11 wherein the stiffer region is located on the outer side of the user's boot.

13. A snowboard binding equipped with a highback as claimed in claim 11.

14. The highback as claimed in claim 1, wherein the stiffer region partially traverses the median plane of symmetry of the highback.

15. The highback as claimed in claim 14, wherein the stiffer region is located on the outer side of the user's boot.

16. A snowboard binding equipped with a highback as claimed in claim 14.

17. A snowboard binding equipped with a highback as claimed in claim 1.

18. The snowboard binding as claimed in claim 10, which has a baseplate intended to be secured to the board via its lower face, wherein the highback has the ability to pivot about an axis substantially perpendicular to the lower face of the baseplate.

19. A snowboard equipped with a binding as claimed in claim 17.

20. A highback for a snowboard binding for receiving a rear part of a user's boot, said highback comprising:

a median longitudinal plane of symmetry and a symmetrical shape relative to said median longitudinal plane of symmetry;

a stiffer region located asymmetrically relative to said median longitudinal plane of symmetry, said stiffer region being shaped skewed toward an outer side of the user's boot; and said stiffer region adapted to receive back thrusts of the user.

* * * * *

UNITED STATES PATENT AND TRADEMARK OFFICE

CERTIFICATE OF CORRECTION

PATENT NO. : 6,508,476 B2
DATED : January 21, 2003
INVENTOR(S) : Joubert Des Ouches It is certified that error appears in the above-identified patent and that said Letters Patent is hereby corrected as shown below:

Column 6,
Line 47, delete "10" and insert -- 17 --

Signed and Sealed this

Tenth Day of June, 2003

JAMES E. ROGAN
*Director of the United States Patent and Trademark Office*